US005718318A

United States Patent [19]

Wachter

[11] Patent Number: 5,718,318

[45] Date of Patent: Feb. 17, 1998

[54] VALIDATING VALUE CARRIERS

[75] Inventor: Arnold Walter Wachter, Downingtown, Pa.

[73] Assignee: Mars Incorporated, McLean, Va.

[21] Appl. No.: 571,819

[22] PCT Filed: Jun. 28, 1994

[86] PCT No.: PCT/IB94/00184

§ 371 Date: Feb. 14, 1996

§ 102(e) Date: Feb. 14, 1996

[87] PCT Pub. No.: WO95/00932

PCT Pub. Date: Jan. 5, 1995

[30] Foreign Application Priority Data

Jun. 28, 1993 [GB] United Kingdom ..... 9313317

[51] Int. Cl.[6] ..... G07F 7/04

[52] U.S. Cl. ..... 194/206; 209/534

[58] Field of Search ..... 194/206, 207; 209/534; 235/379

[56] References Cited

U.S. PATENT DOCUMENTS

| | | | |
|---|---|---|---|
| 4,473,157 | 9/1984 | Hirose et al. | 209/534 |
| 4,510,380 | 4/1985 | Uchida et al. | 194/206 |
| 4,585,928 | 4/1986 | Watanabe | 235/379 |
| 4,723,072 | 2/1988 | Naruse | 209/534 X |
| 4,726,474 | 2/1988 | Arikawa et al. | 194/206 X |
| 4,883,183 | 11/1989 | Kimura et al. | 209/534 |
| 5,076,441 | 12/1991 | Gerlier . | |

FOREIGN PATENT DOCUMENTS

| | | | |
|---|---|---|---|
| 0155126 | 9/1985 | European Pat. Off. . | |
| 0 473 106 | 3/1992 | European Pat. Off. . | |
| 1375390 | 11/1974 | United Kingdom . | |
| 1430099 | 3/1976 | United Kingdom . | |
| 2100906 | 1/1983 | United Kingdom . | |
| 2122010 | 1/1984 | United Kingdom . | |
| 2204682 | 11/1988 | United Kingdom | 194/206 |
| WO 92/10816 | 6/1992 | WIPO . | |

*Primary Examiner*—F. J. Bartuska

*Attorney, Agent, or Firm*—Fish & Richardson P.C.

[57] ABSTRACT

The method of checking the acceptability of value carriers (2) in automatic machines (3) that both accept and return such value carriers consists of carrying out the check according to two acceptance criteria. The first defines the conditions for the acceptance of a value carrier, the second, more rigorous, criterion defines the conditions for the re-use of a value carrier. The device (1) for carrying out the method includes a measuring unit (13), a decision unit (14) and a control unit (15). The value carriers that are not to be re-used are conveyed by transport device (21, 23) to one-way stores (16); those that are available to be re-used are conveyed by transport device (21, 24) to two-way stores (17). The value carriers that are not accepted are transported directly back to the dispensing opening (12).

23 Claims, 1 Drawing Sheet

VALIDATING VALUE CARRIERS

FIELD OF THE INVENTION

The invention relates to a method and apparatus for validating value carriers, such as banknotes, coins or tokens.

BACKGROUND OF THE INVENTION

The method of the present invention can be applied where value carriers are to be accepted from one person by an automatic machine, such as an automatic teller machine or a vending machine, and passed on to another person. In the following, the description is restricted to use with banknotes, that is to say, where automatic machines accept banknotes in payment and dispense accepted banknotes as money returned, for example, either as change in vending machines or payphones or as banknotes of lower denomination or of a different currency in banknote-changing machines. Thus "dispensing" as used in this specification is intended to be construed accordingly, as opposed to the rerun of a value carrier which is deemed by a machine not to be valid. Furthermore, the term "valid" could, for example, imply that a credit value is established or incremented in respect of the value carrier presented.

Automatic machines that allow banknotes that have been paid in to be re-used, that is to say put into circulation again as dispensed money, are already known, for example, from U.S. Pat. No. 5,076,441. In such automatic machines, the "acceptability", that is, for example, the authenticity, and frequently, in addition, the general condition of the banknotes offered to the automatic machine are also checked. This is done by comparing one or more measurements that can be made of the banknote with corresponding given reference values or tolerance ranges which are normally stored in the automatic machine. The choice of parameters which are measured depends primarily upon the recognition characteristics existing on the banknote. A pre-requisite for this, of course, is that "acceptable" and non-"acceptable" notes can be statistically differentiated by measuring techniques, that is to say that at least the expected values of the measured parameters are different.

If the measurement or measurements of a banknote do not fall within the given tolerance ranges, it is concluded that the banknote is not acceptable, that is to say either is not genuine or is not in a good condition. It is therefore rejected by the automatic machine. Conversely, if the measurement or measurements lie within the tolerance ranges, it is concluded that the banknote is acceptable, that is to say is genuine and in a good condition. It is therefore accepted by the automatic machine in payment for a return service, is stored and is available for re-use, if required, in the form of dispensed money. Such a checking method is subject to two opposing requirements: on the one hand, when checking whether The banknote offered for payment is acceptable, the risk of a "good" banknotes being rejected is to be restricted To a minimum. This is achieved, in an automatic machine that is in itself adjusted correctly, fundamentally by making the acceptance criterion broader. On The other hand, the accepted banknote which is available to the automatic machine as money for change purposes is, with the greatest possible reliability, to be actually "acceptable", that is to say genuine and in a good condition. Although the percentage of "bad" banknotes accepted with a given acceptance criterion naturally depends upon how the "bad" banknotes differ from the "good", it is nevertheless clear that making the acceptance criterion broader basically increases the probability of a "bad" banknote being accepted by the automatic machine.

The second requirement, therefore, corresponds to the opposite requirement that the acceptance criterion be made narrower.

In practice, therefore, a compromise is made in which the tolerance value or values are chosen such that both the probability of an acceptable banknote being rejected and the probability of a non-acceptable banknote being re-used are kept within limits. In known automatic machines, an acceptance rate of, for example, 95–99% is chosen, that is to say 95–99% of all "good" banknotes checked by the automatic machine are accepted. Thus, the probability of a "bad" banknote being accepted and subsequently re-used can normally be kept sufficiently small, such as below 1%.

SUMMARY OF THE INVENTION

In accordance with the present invention there is provided a method of, and apparatus for, accepting, validating and dispensing value carriers, wherein one or more parameters of a value carrier presented by a user are measured and the value carrier is accepted as valid if each parameter falls within a corresponding first acceptance range, wherein the value carrier is subsequently dispensed only if each parameter falls within a corresponding second acceptance range narrower than the first.

In the preferred embodiments, validation is carried out against the first acceptance range in such a manner that as few genuine banknotes as possible are rejected and, against the second acceptance range, in such a manner that, of the banknotes accepted and stored according to the first acceptance range, as far as possible all banknotes that may not be genuine are retained in the automatic machine.

Preferred embodiments of the invention are described below with reference to the drawings.

DETAILED DESCRIPTION

Figure 1:
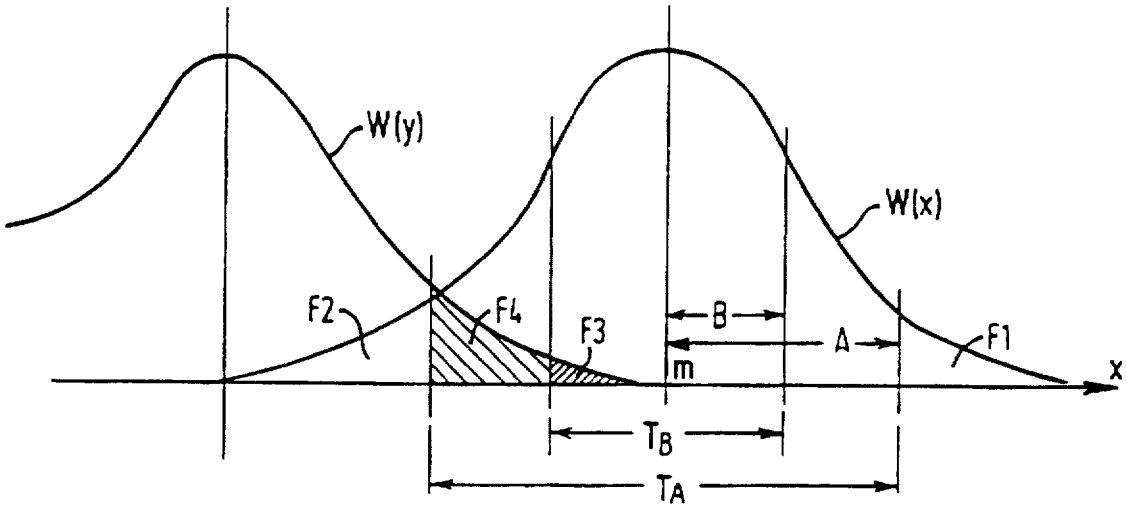
FIG. 1 shows a probability distribution of a measuring parameter for "good" baritones with two acceptance criteria and a probability distribution for "bad" banknotes.

FIG. 1 shows, by way of example, the probability distribution W(x) for a measuring parameter x with a mean value m. The measurement in question is one with which non-acceptable banknotes have parameter values y that have a probability distribution W(y) that is changed by comparison wick x.

The given Tolerance values A and B define the two acceptance ranges $T_A$ and $T_B$: if, for the measured parameter value x, the absolute value of (x–m) is less than A, the banknote is regarded as acceptable. The probability of a genuine note being rejected is given by the area F1+F2. The probability of a non-acceptable banknote being accepted is given by the area F3+F4. Of the notes accepted there are then selected for re-use, in a second decision, only those banknotes in which the absolute value of (x–m) does not exceed the value B. This measure further increases the probability that only genuine banknotes will be re-used: the area F3 corresponds to the probability of a counterfeit note being regarded as genuine and re-used. The area F4 corresponds to those banknotes which, although accepted by the automatic machine, are no longer assigned for re-use.

In the normal case, several measuring parameters x1, x2, . . . , xn are measured and compared with acceptance ranges $T_{A1}, T_{A2}, \ldots, T_{An}$ and $T_{B1}, T_{B2}, \ldots, T_{Bn}$ (Bi<Ai), the acceptance range $T_{Ai}$ having a mean value mi and a maximum deviation of Ai>0, i.e.

$$T_{Ai}=[mi-Ai, mi+Ai]$$

and the acceptance range $T_{Bi}$ has the same mean value mi and a maximum deviation of Bi>0 (where Ai>Bi), i.e.

$$T_{Bi}=[mi-Bi, mi+Bi],$$

the first acceptance criterion consisting in that, for xi in $T_{Ai}$ for all i, i=1, . . . , n, the banknote is accepted, and the second acceptance criterion consisting in than, for xi in $T_{Bi}$ for all i, i=1, . . . , n, the banknote is assigned for re-use.

The characteristic values {mi}, {Ai} and {Bi} are stored in a data store 30 of the decision unit 14.

One possible measuring parameter xi is the dimension, that is to say the length, width or thickness of the banknote. Another advantageous measuring parameter xi is the spectrum of the light reflected or transmitted by the banknote, as described in DE-A-2 924 605. One or more predetermined parts of the banknote may be measured. A further measuring parameter xi that can be used is the change produced in a magnetic field by a banknote provided with magnetic printing ink, as described in U.S. Pat. No. 4,864,238.

The measurements {xi} are compared with acceptance ranges $\{T_{Ai}\}$ and $\{T_{Bi}\}$ stored in the decision unit 14. Preferably, the initial acceptance ranges $\{T_{Ai}\}$ are determined offline with the aid of a representative amount of acceptable banknotes, are stored in the data store 30 of the decision unit 14 and are adapted in the course of time to the changes in the measuring apparatus and to the characteristics of the banknotes in circulation (see, for example, GB-A-2 059 129).

The method can also be applied to automatic machines that accept different types of banknote w1, w2, . . . , wn and dispense them again. The method is in that case preceded by a first step in which first the type of banknote wi is determined. In most countries, this can be done on the basis of identifying the dimensions of the notes; it may, however, be the case that this test is not sufficiently reliable or even possible, such as, for example, in the case of U.S. notes which all have the same dimensions.

Figure 2:
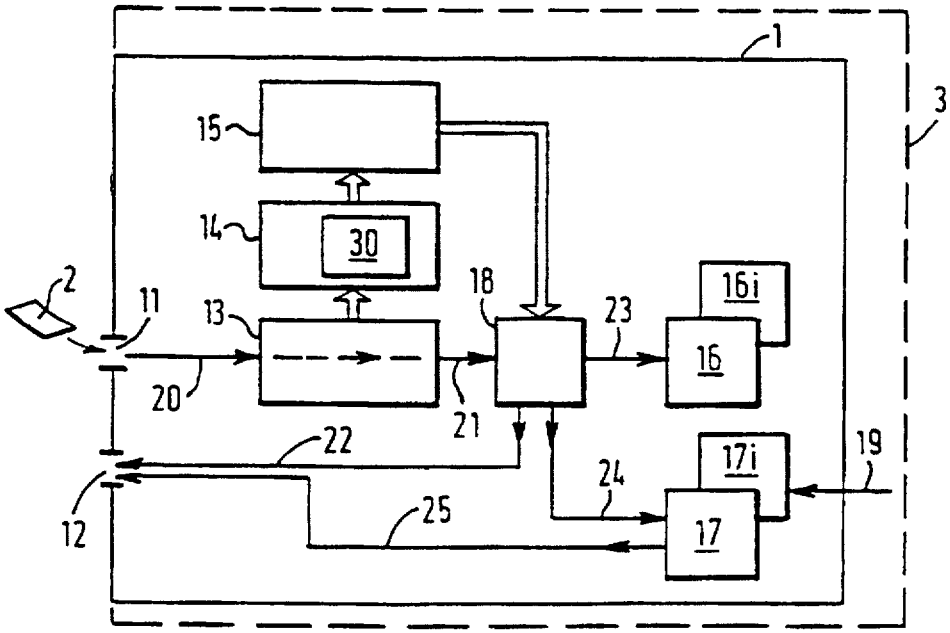
FIG. 2 is a diagrammatic view of the device for validating banknotes.

FIG. 2 shows the diagrammatic arrangement of a device 1 according to the invention. It has at least one acceptance opening 11 and at lease one dispensing opening 12 for accepting and returning value carriers, and further consists of a measuring unit 13, a decision unit 14 with data store 30, a control unit 15, at least one one-way store 16, **16*i* and an least one two-way store 17, 17*i*. These units are connected by transport means 20, 21, 22, 23, 24, 25 and a common routing element 18**.

After a value carrier 2 has been inserted into the acceptance opening 11 it is taken by a first transport means 20 to the measuring unit 13 which contains the measuring apparatus required for checking acceptability. The parameter measurements determined there are passed to the decision unit 14 which compares them with the tolerance ranges stored in the data store 30 and decides whether the value carrier is acceptable and, if so, whether it can be assigned for re-use. The control unit 15 is instructed to control the common routing element 18 of the transported system accordingly: upon leaving the measuring unit 13 a non-acceptable value carrier is transported directly back to the dispensing opening 12, an acceptable value carrier that is not to be re-used is directed by the routing element 18 onto transport means 23 and is transported to one of several one-way snores 16, **16*i*, an acceptable value carrier than is to be available for re-use is directed by the routing element 18 onto transport means 24 and is taken to one of several two-way stores 17, 17*i*** and snored.

The two-way stores 17, **17*i* can be controlled by the automatic machine 3 via control means 19 to supply the desired type and number of value carriers 2 to the dispensing opening 12 via transport means 25**.

The acceptability zest is carried cut in detail as follows: after the banknote 2 has been inserted into the measuring unit 13 the n scheduled measurements x1, x2, . . . , xn are determined and passed on to the decision unit 14 where it is established whether the measurement xi falls within the range $T_{Ai}$ for all i. If that is not the case, the banknote is returned to the user by the automatic machine at the dispensing opening 12. If xi is within $T_{Ai}$ and also within $T_{Bi}$, for all i, i=1, . . . , n, the banknote is conveyed to one of the two-way stores 17, **17*i* from whence it is available for re-use as money returned. If that is not the case, that is, while xi is within $T_{Ai}$ it is not within $T_{Bi}$ for all i, i=1, . . . , n, the banknote is deposited in one of the one-way stores 16, 16*i* where it remains until the automatic machine 3** is emptied.

Although, in the preferred embodiments, two separate storage devices are provided for each type of value carrier, it would be possible to provide a single storage device wherein the position of the value carrier within that storage device is known. In this case, the value carriers would be dispensed selectively so than only those which meet both acceptance criteria are dispensed, while retaining those value carriers which meet only one of the acceptance criteria.

Alternatively, all value carriers accepted by the machine according no the first criterion K1 could be stored in a single storage device and a subsequent validation performed according to the second criterion K2 on value carriers leaving the storage device. Such value carriers would either be returned to the user or retained within the automatic machine in dependence on whether or not the second criterion K2 is met.

Furthermore, although separate acceptance and dispensing openings have been described, it is possible to provide a single opening for performing both functions.

I claim:

1. A method of accepting, validating and dispensing value carriers, comprising the steps of measuring a parameter of a value carrier presented by a user, accepting the value carrier as valid if the parameter falls within a corresponding first acceptance range, and subsequently dispensing the value carrier only if the parameter falls within a corresponding second acceptance range narrower than the first.

2. A method as claimed in claim 1, including storing all accepted value carriers in a single storage means, the positions thereof within said storage means being known, and selectively dispensing said value carriers using said known positions.

3. A method as claimed in claim 1, including storing all accepted value carriers in a single storage means, and comparing the parameter with the corresponding second acceptance range after the value carrier has left the storage means.

4. A method according to claim 1, wherein the value carriers belong to various types w1, w2, . . . , wn the method further comprising identifying the type of value carrier wi, type-specific characteristic values of the first and second acceptance ranges being stored, the method further including storing the accepted value carriers in separate, type-specific first and second storage means.

5. A method as claimed in claim 1, wherein if the parameter does not fall within said corresponding first acceptance range, the value carrier is returned directly to a dispensing opening.

6. A method as claimed in claim 1, in which the parameter is indicative of the authenticity of the value carrier.

7. A method as claimed in claim 1, including measuring a plurality of parameters and accepting the value carrier as valid if each parameter falls within a corresponding first acceptance range.

8. A method as claimed in claim 7, including subsequently dispensing the value carrier only if each parameter falls within a corresponding second acceptance range, which is narrower than the corresponding first acceptance range.

9. A method of checking value carriers in automatic machines which accept value carriers in payment comprising storing them in at least first and second storage means, and, when instructed by a control unit, returning them to a user of the automatic machine, including, before acceptance and storage, comparing one or more parameters of each value carrier with a corresponding first acceptance range wherein the method further comprises comparing the parameter or parameters of each value carrier with a corresponding second acceptance range which is narrower than the first, storing the value carriers for which each parameter satisfies only the corresponding first acceptance range in said first storage means and storing the value carriers for which each parameter satisfies the corresponding second acceptance range in said second storage means, the value carriers stored in said second storage means being available to be redispensed to a user.

10. A method according to claim 9, wherein each first acceptance range is determined on the basis of measurements of said corresponding parameter performed on a representative number of acceptable value carriers and is stored in the automatic machine before being put into service.

11. A method according to claim 10, wherein each stored first acceptance range is adapted during service to compensate for changes in the measuring apparatus and changes in the characteristics of the value carriers in circulation.

12. A method according to claim 9, wherein each first acceptance range $T_{Ai}$ has a mean value mi and a maximum deviation of Ai>0, i.e.

$$T_{Ai}=[mi-Ai,mi+Ai],$$

and each second acceptance range $T_{Bi}$ has the same mean value mi and a maximum deviation of Bi>0, where Ai>Bi, i.e.

$$T_{Bi}=[mi-Bi,mi+Bi],$$

and the characteristic values {mi}, {Ai} and {Bi} are stored in a data store of a decision unit.

13. A method according to claim 12, wherein a change in the measuring apparatus is detected by periodically measuring a fixed reference value and is corrected by adapting the mean values {mi} stored in the data store.

14. A method according to claim 12, wherein a change in the characteristics of the value carriers in circulation is compensated for by adapting each mean value {mi} stored in the data store according to each parameter value measured in the accepted value carriers.

15. Apparatus for accepting, validating and dispensing value carriers, the apparatus comprising means for validating a value carrier presented by a user by measuring one or more parameters of the value carrier and means for accepting said value carrier as valid if each parameter falls within a corresponding first acceptance range but subsequently dispensing the value carrier if each parameter falls within a second acceptance range narrower than the first.

16. Apparatus for accepting and returning value carriers comprising opening means defining at least one opening for accepting and/or dispensing a value carrier, a measuring unit for measuring one or more parameters of a value carrier presented by a user, a decision unit for deciding whether each parameter falls within a corresponding first acceptance range and a corresponding second acceptance range narrower than the first, first and second storage means for the value carriers and a transport system arranged to transport value carriers from the opening means to the measuring unit, from the measuring unit to one of the opening means, said first storage means and second storage means, in dependence on the output of the decision unit and from the second storage means back to the opening means, the arrangement being such that only those value carriers for which each parameter falls within the corresponding first acceptance range are stored in the first and second storage means and only those value carriers for which each parameter falls within the corresponding second acceptance range are stored in the second storage means.

17. Apparatus according to claim 16, wherein the measuring unit has an outlet, and wherein from the outlet of the measuring unit and via a routing element, the transport system is arranged to transport a non-acceptable value carrier directly back to the opening means, direct an acceptable value carrier that is not to be re-used to the first storage means, and direct an acceptable value carrier that is to be available for re-use to said second storage means.

18. Apparatus according to claim 16, further comprising a data store for storing characteristic values of the first and second acceptance ranges.

19. Apparatus according to claim 18, arranged to accept and return a plurality of types of value carrier, the measurements in the measuring unit serving also to identify the type of value carrier, type-specific characteristic values of the first and second acceptance ranges being stored in the data store and the accepted value carriers being stored in separate, type-specific first or second storage means.

20. Apparatus according to claim 16, wherein the one or more parameters measured by the measuring unit are indicative of the authenticity of the banknote.

21. Apparatus for accepting, validating and dispensing value carriers, the apparatus comprising validating means for validating a value carrier presented by a user by measuring a parameter of the value carrier and accepting said value carrier as valid if the parameter falls within a corresponding first acceptance range, wherein the validating means is arranged subsequently to dispense the value carrier if the parameter falls within a corresponding second acceptance range narrower than the first.

22. Apparatus as claimed in claim 21, wherein the validating means is arranged to measure a plurality of parameters and to accept the value carrier as valid if each parameter falls within a corresponding first acceptance range.

23. Apparatus as claimed in claim 22, wherein the validating means is arranged to dispense the value carrier only if each parameter falls within a corresponding second acceptance range narrower than the corresponding first acceptance range.

* * * * *

UNITED STATES PATENT AND TRADEMARK OFFICE

CERTIFICATE OF CORRECTION

PATENT NO. : 5,718,318

DATED : February 17, 1998

INVENTOR(S) : Arnold Wachter

It is certified that error appears in the above-identified patent and that said Letters Patent is hereby corrected as shown below:

Col. 1, line 19, delete "rerun" and insert --return--.

Col. 1, line 53, delete "The" and insert --the--.

Col. 1, line 55, delete "To" and insert --to--.

Col. 1, line 58, delete "The" and insert --the--.

Col. 2, line 38, delete "baritones" and insert --banknotes--.

Col. 2, line 50, delete "wick" and insert --with--.

Col. 2, line 51, delete "Tolerance" and insert --tolerance--.

Col. 3, line 14, delete "than" and insert --that--.

Col. 4, line 3, delete "snores" and insert --stores--.

Col. 4, line 8, delete "snored" and insert --stored--.

Col. 4, line 13, delete "zest" and insert --test--.

Col. 4, line 13, delete "cut" and insert --out--.

UNITED STATES PATENT AND TRADEMARK OFFICE

CERTIFICATE OF CORRECTION

PATENT NO. : 5,718,318

DATED : February 17, 1998

INVENTOR(S) : Arnold Wachter

It is certified that error appears in the above-identified patent and that said Letters Patent is hereby corrected as shown below:

Col. 4, line 37, delete "no" and insert --to--.

Signed and Sealed this

Ninth Day of June, 1998

*Attest:*

*Attesting Officer*

BRUCE LEHMAN

*Commissioner of Patents and Trademarks*